US007780377B2

(12) United States Patent
Brady et al.

(10) Patent No.: US 7,780,377 B2
(45) Date of Patent: Aug. 24, 2010

(54) FRICTION STABILIZERS AND ROOF BOLT HEAD MARKINGS

(76) Inventors: Steven E. Brady, 3900 W. 700 S., Salt Lake City, UT (US) 84104-4444; Roland C. Walker, 3900 W. 700 S., Salt Lake City, UT (US) 84104-4444; Matthew S. Slatter, 3900 W. 700 S., Salt Lake City, UT (US) 84104-4444

( * ) Notice: Subject to any disclaimer, the term of this patent is extended or adjusted under 35 U.S.C. 154(b) by 0 days.

(21) Appl. No.: 12/221,815

(22) Filed: Aug. 6, 2008

(65) Prior Publication Data

US 2010/0034595 A1 Feb. 11, 2010

(51) Int. Cl.
*E21D 21/00* (2006.01)
*E21D 20/00* (2006.01)

(52) U.S. Cl. ..... 405/259.1; 405/259.3

(58) Field of Classification Search ..... 405/259.1, 405/259.2, 259.3, 259.4, 302.2
See application file for complete search history.

(56) References Cited

U.S. PATENT DOCUMENTS 4,012,913 A * 3/1977 Scott ..... 405/259.3
4,126,004 A * 11/1978 Lindeboom ..... 405/259.1
4,310,266 A * 1/1982 Malsbury et al. ..... 405/259.1
4,314,778 A * 2/1982 Cantrel ..... 405/259.3
4,334,804 A * 6/1982 Lindeboom ..... 405/259.1
4,382,719 A * 5/1983 Scott ..... 405/259.3
4,400,113 A * 8/1983 Chaiko et al. ..... 405/259.1
4,490,074 A * 12/1984 Chaiko ..... 405/259.1
5,192,146 A * 3/1993 Landsberg ..... 405/259.1
5,295,768 A * 3/1994 Buchhorn et al. ..... 405/259.3
5,297,900 A * 3/1994 Witzand ..... 405/259.3
5,415,498 A * 5/1995 Seegmiller ..... 405/302.1
5,649,790 A * 7/1997 Mergen et al. ..... 405/259.3
5,664,921 A * 9/1997 Leslie ..... 411/427
5,769,570 A * 6/1998 Stankus et al. ..... 405/302.1
5,885,034 A * 3/1999 Fergusson ..... 405/302.1
5,931,606 A 8/1999 Karlsen
6,073,552 A * 6/2000 Cruse et al. ..... 411/378
6,402,433 B1 * 6/2002 Gillespie ..... 405/259.1
6,484,471 B2 * 11/2002 Steed et al. ..... 405/259.5

* cited by examiner

*Primary Examiner*—Frederick L Lagman
(74) *Attorney, Agent, or Firm*—Ronald R. Kilponen

(57) ABSTRACT

A roof stabilizer for use in securing surfaces in tunneling and mining is disclosed and claimed. The stabilizer has a tube with a slot and a ring attached to the bottom end of the tube. The ring can have indicia on a bottom surface of the ring or a side surface of the ring or both. The location of the indicia can provide better indication of the properties of the stabilizer to the installer. The indicia is easier to read than that of the background art both before and after installation. The location of the indicia can also provide easer and quicker visual inspection of already installed stabilizers to verify that the proper roof stabilizers were installed. The location of the indicia lessens the likelihood that corrosion will remove the indicia making it unidentifiable. The stabilizer disclosed and claimed also allows the use of grout or an adhesive in the interior of the tube which does not cover up or conceal the indicia on the ring as opposed to indicia in the background art stabilizers. Also disclosed are various locations and methods for placing indicia on the heads of roof bolts. Such indicia locations and methods for placement also aid in the pre and post installation and inspection of roof bolts to provide easier verification that devices with the correct properties were installed.

4 Claims, 5 Drawing Sheets

Fig. 4
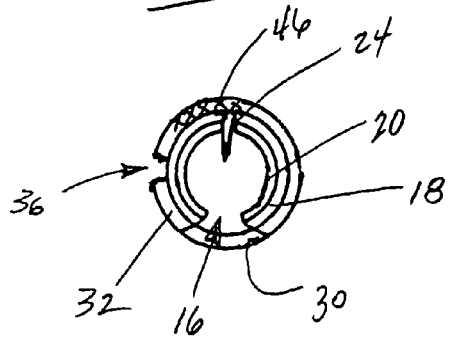
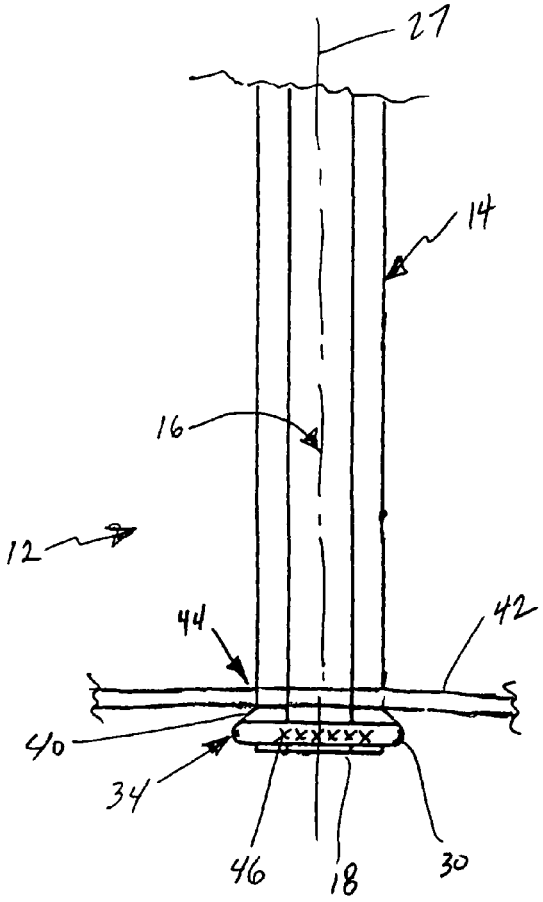
Fig. 2
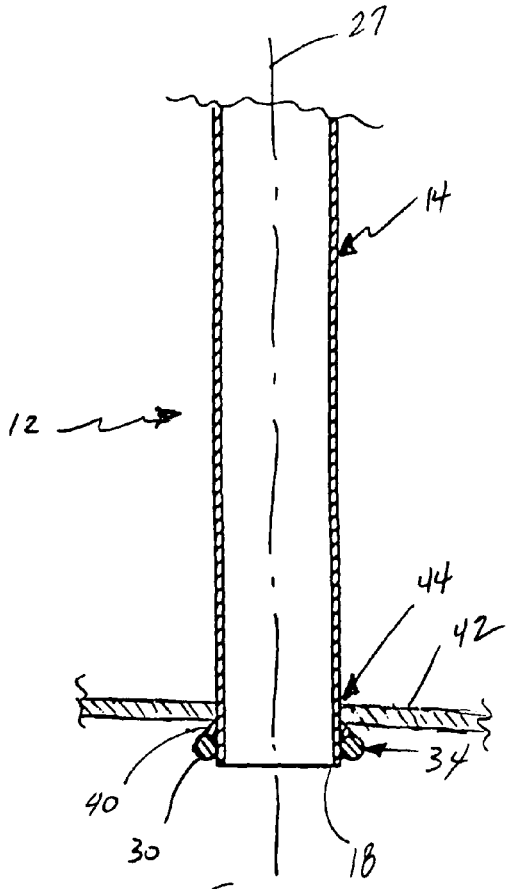
Fig. 3

FRICTION STABILIZERS AND ROOF BOLT HEAD MARKINGS

FIELD

The present version of this device relates generally to the field of identifying roof bolts or stabilizers that are used in the mining or tunneling industry.

BACKGROUND

This device relates to the identification of roof bolts or stabilizers that are used in the mining industry or tunneling underground, and more particularly to the marking and identification of roof bolts and stabilizers that can be more easily identified pre and post installation.

Many different types of devices and methods are used to secure the roofs in mining or tunneling operations. Generally these devices consist of cables, rods, screws or tube like stabilizers that are inserted through a hole in a plate of some kind and into holes drilled in the roofs or walls of the tunnels. These devices can penetrate great distances into the ceilings or walls dependent upon the consistency or materials in the roof or walls and the stabilization plan. The plates generally sit flush against the ceiling (for example) in the tunnels and the bolts or stabilizers are secured in the drilled holes in the ceiling. The bolts or stabilizers are in tension and the plates help retain the roof material in position once the tunnel material is removed and this helps prevent ceiling failures or collapse. Stabilizers once installed, can then have a grout or an adhesive inserted into the interior of the tube of the stabilizer that aids in securing the stabilizer in the roof or ceiling.

One method of aiding in the securing of the ceilings or walls of mining tunnels is to first drill a hole and check the material removed. This drilling and other methods tell the operator how deep the hole should be drilled and how long the stabilizer or roof bolt should be. Once the hole depth has been determined, the appropriate type of device of the appropriate length and properties can be inserted into the hole and secured. Securing can be done by a number of different methods known in the art. Some roof stabilizers use a grout, others use an epoxy material and still others use neither but are held in place via friction from the outer surface of the stabilizer in the hole drilled in the roof material.

Some stabilizers have a roof bolt inserted along with the grout or epoxy into the stabilizers to aid in retaining the stabilizers in the hole in the rock. The roof bolts generally have a head of various designs attached to an extension that varies in length depending upon the roof plan and length of the stabilizer. The extensions can be cable, solid rod, threaded rods or various other designs known in the art. These bolts suffer from the same pre and post installation identification problems as the stabilizers.

All stabilizers have indicia to indicate various properties of the stabilizer, for example only and in no way meant to be a limitation, length, material, strength, date of manufacture, lot number, machine manufactured on, plant or manufacturers facility and others. The problem with much of the background art is that this indicia is located on the interior surface of the stabilizer. This can be impossible to see if the stabilizer has a grout, epoxy material and/or a roof bolt inserted into the stabilizer. Any material or device inserted into the stabilizer can cause difficulty in reading the indicia if the stabilizer is many feet away from the inspector or installer. The indicia may become difficult to read from corrosion of the stabilizer itself or the indicia may wear or flake off.

It is important to enable one to visually verify that the proper length stabilizers have been inserted into the proper depth hole to make sure that the roof plan has been followed. The Applicant's device allows the stabilizers to be visually verified before installation and visually verified at a later date for inspection, even if the roofing plan has been lost or was not fully completed. The Applicant's device is more clearly visible to the installers and inspectors and is much less likely to become corroded to a point that the indicia is not visible. Inspection can thus be done at a much later date even in low light conditions.

Several other methods such as paint or locating the ring at a particular angle relative to a slot in the stabilizer have been found to somewhat enable visual inspection, but have been unsuccessful for one reason or another and none have been successfully accepted by many in the tunneling or mining industry.

For the foregoing reasons, there is a need for a stabilizer or roof bolt that allows the relative simple visual inspection of the stabilizer or roof bolt to verify the length and other properties of the stabilizer or roof bolt both before and after installation.

SUMMARY

In view of the foregoing disadvantages inherent in the background art of roof stabilizers and roof bolts there is a need for a device that allows for the simple visual verification of the length and other properties of the roof bolts and stabilizers both before and after installation.

A first objective of these devices is to provide a device that can be installed with current technology.

Another objective of these devices is to provide a device wherein the length can be quickly and easily verified before it is installed.

An additional objective of these devices is to provide a device that once installed, can provide a quick visual verification of the properties of the device after installation.

It is yet another objective of these devices to provide for a relatively quick visual inspection of stabilizers and bolts that are less subject to indicia corrosion, flaking or wear.

It is a still further objective of the devices disclosed to provide a device where properties can more easily be read in a low light environment.

Another objective of these devices is to provide a stabilizer where properties can be verified after a grout or adhesive has been inserted into the tube for retaining the stabilizer.

These together with other objectives of these devices, along with various features of novelty which characterize these devices, are pointed out with particularity in the claims annexed hereto and forming a part of this disclosure. For a better understanding of these devices, their operating advantages and the specific objectives attained by their uses, reference should be had to the accompanying drawings and descriptive matter in which there is illustrated a preferred embodiment of this device.

BRIEF DESCRIPTION OF DRAWINGS

FIG. 2 shows a partial side view of one embodiment of the Applicant's device with indicia on the side surface of the ring.

FIG. 3 shows a partial side cutaway view of one embodiment of the Applicant's device.

FIG. 4 shows a bottom end view of one embodiment of the Applicant's device with indicia on a bottom surface of the ring.

DETAILED DESCRIPTION OF THE PREFERRED EMBODIMENTS

Figure 1:
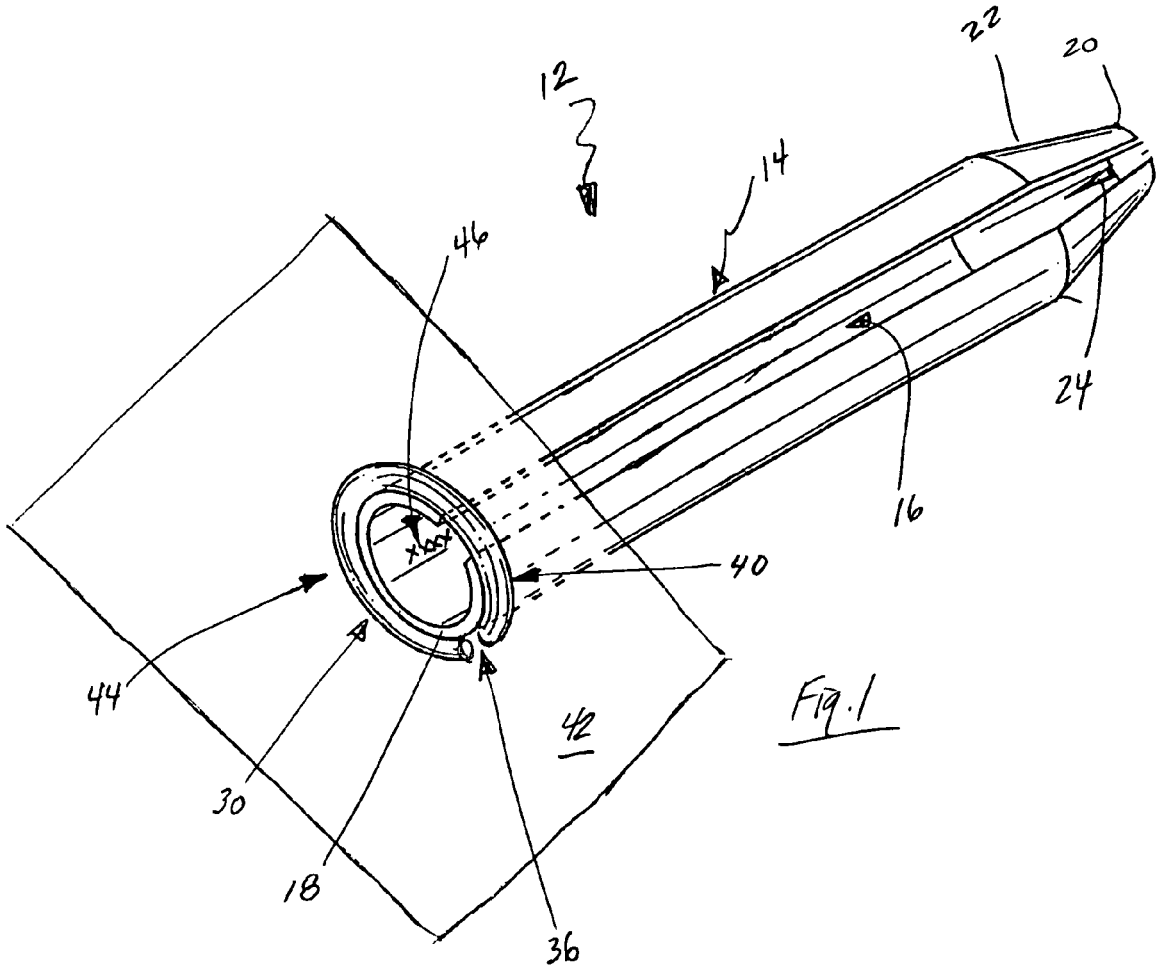
FIG. 1 shows a perspective view of one embodiment of the device showing the indicia of the background art on the interior of the tube.

Referring to the drawings in detail wherein like elements are indicated by like numerals, there is shown in FIG. 1 a perspective view of a stabilizer 12. The stabilizer 12 has a tube 14 engaging a plate 42 through hole 44 in plate 42. The tube 14 has a ring 30 with an opening 36 affixed with a weld 40 near a bottom end 18 of the tube 14, also FIGS. 2-3.

The top end 20 of the tube 14 can have a taper 22 which eases the insertion of the tube 14 into a hole drilled in the ceiling or wall of the tunnel or shaft. The tube 14 also has a slot 16 in the side wall of the tube 14 running from the bottom end 18 to the top end 20 and approximately parallel to an axis 27. This embodiment of the tube 14 also shows a fold 24 is formed by folding the side wall of the tube 14 in forming the taper 22 at the top end 20. This embodiment of the stabilizer 12, shows indicia 46 located on the interior of the tube 14 near the bottom end 18. The background art commonly uses indicia 46 on the inside of the tube 14 to indicate the length of the tube 14 and various other properties that are of importance in roof stabilizers 12.

FIG. 2 shows a partial side view of one of Applicant's embodiments of the stabilizer 12. This embodiment likewise has a tube 14 with slot 16 running from the bottom end 18 to the top end 22 (not shown) and approximately parallel to axis 27. A ring 30 is attached to the tube 14 with a weld 40 near the bottom end 18. The stabilizer 12 is inserted through the plate 42 such that the plate 42 and weld 40 of ring 30 are adjacent one another. The plate 42 is thereby retained by stabilizer 12. The top end 20 of the stabilizer 12 is inserted into the hole in the ceiling of the tunnel (not shown).

The plate 42 is located flush with the ceiling or surface that requires support. This embodiment shows indicia 46 on the side surface 34 of the ring 30. The indicia 46 can be applied by various methods such as: stencil, laser, electronic pen, pencil marking, scribe, scroll pen, rolling dies, press or stamping, embossed, debossed and various other methods that would provide a relatively permanent indicator. The indicia can also be done during manufacturing of ring 30 or post assembly of the ring 30 to the tube 14.

FIG. 3 shows a partial cutaway side view of the stabilizer 12 more clearly showing the ring 30 attached with weld 40 to tube 14.

FIG. 4 shows a bottom 18 end view of one embodiment of the Applicant's device. In this embodiment, the indicia 46 is shown on the bottom surface 32 of the ring 30.

It can be appreciated that applying the indicia to the bottom surface 32 or side surface 34 of the ring 30, or even both surfaces is beneficial and desirable to the user. It can be appreciated that if grout or adhesive is inserted into the tube 14 of the stabilizer 12, the indicia on the interior of the tube 14 as the background art utilizes would not be visible. The grout or adhesive may be covering the indicia 46, FIG. 1, either completely, or residual grout or adhesive may obscure the indicia 46. The ability to see the indicia 46 once the stabilizer 46 has been installed allows for easier inspection of the stabilizer 46. It is beneficial to relatively easily verify visually that the correct stabilizer 12 has been installed.

Having indicia 46 on either the bottom surface 32 or side surface 34 or both of ring 30 can also help prevent the installation of the incorrect stabilizer 12. Since these stabilizers 12 play an integral part in helping to prevent roof or ceiling failures, any opportunity to aid in error prevention is extremely beneficial.

Figure 5:
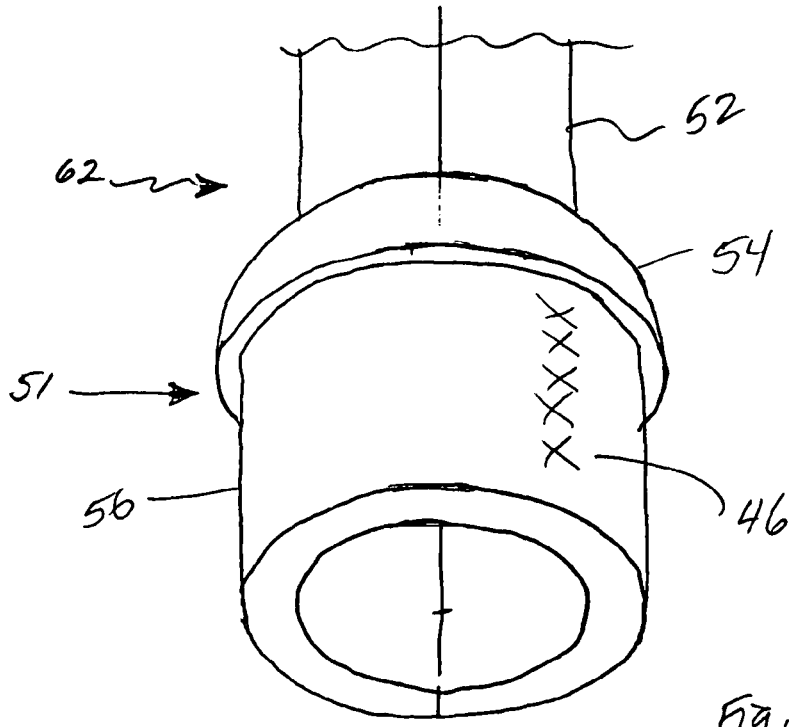
FIG. 5 shows a side perspective view of another embodiment of indicia location on a roof bolt.

FIG. 5 shows one embodiment of a head 51 attached to an extension 52 of a roof bolt 62. The extension 52 can be a cable, solid rod, threaded rod or various other designs known in the art. The extensions 52 can be manufactured to various lengths dependent upon the users needs. FIG. 5 shows a bowl shaped cup 54 attached to the extension 52 on the small end and a shoulder 56 attached to the opposite end. The cup 54 aids in self centering the head 51 in the hole 44 of plate 42 (not shown). As can be appreciated, when the extension 52 is driven into the hole 44 of plate 42, the head 51 contacts the plate 44, the cup 54 of head 51 will center in the hole 44 to provide the compressive force to the plate 42 to hold the roof material.

Figure 6:
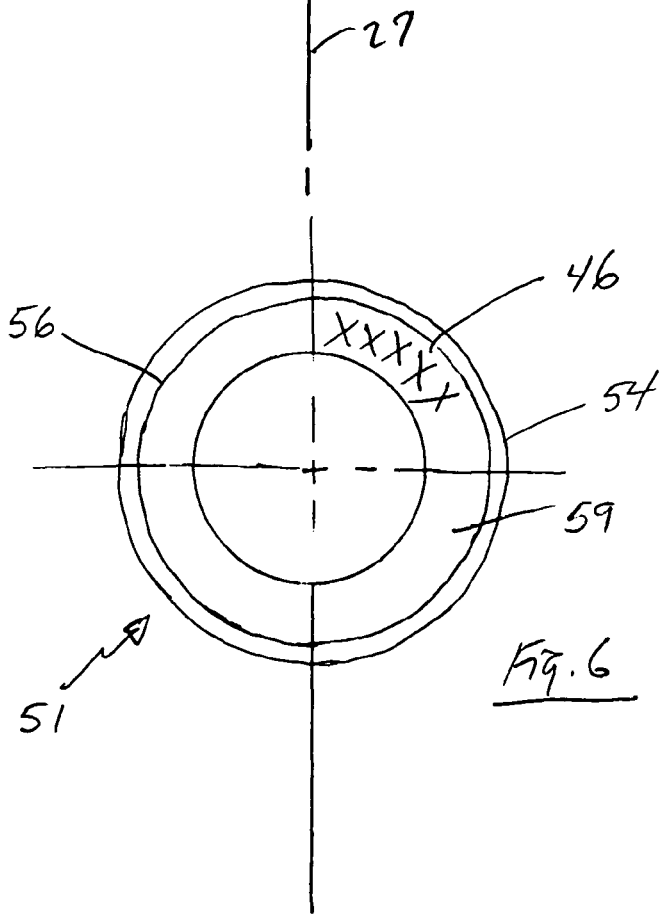
FIG. 6 shows an end view of another embodiment of indicia location of the device in FIG. 5.

FIG. 5 shows indicia 46 located on the shoulder 56 and FIG. 6 shows indicia 46 on the bottom 59 of the shoulder 56. Indicia 46 could be located at either of these locations alone or both. The location of the indicia 46 significantly aids in identifying various properties of the roof bolt 62 and allows easier inspection of the roof bolts 62 post installation. This location of indicia 46 also allows the installer to double check to make sure that roof bolts 62 having the appropriate properties have been installed to appropriately sized stabilizers 12 before installation.

Figure 7:
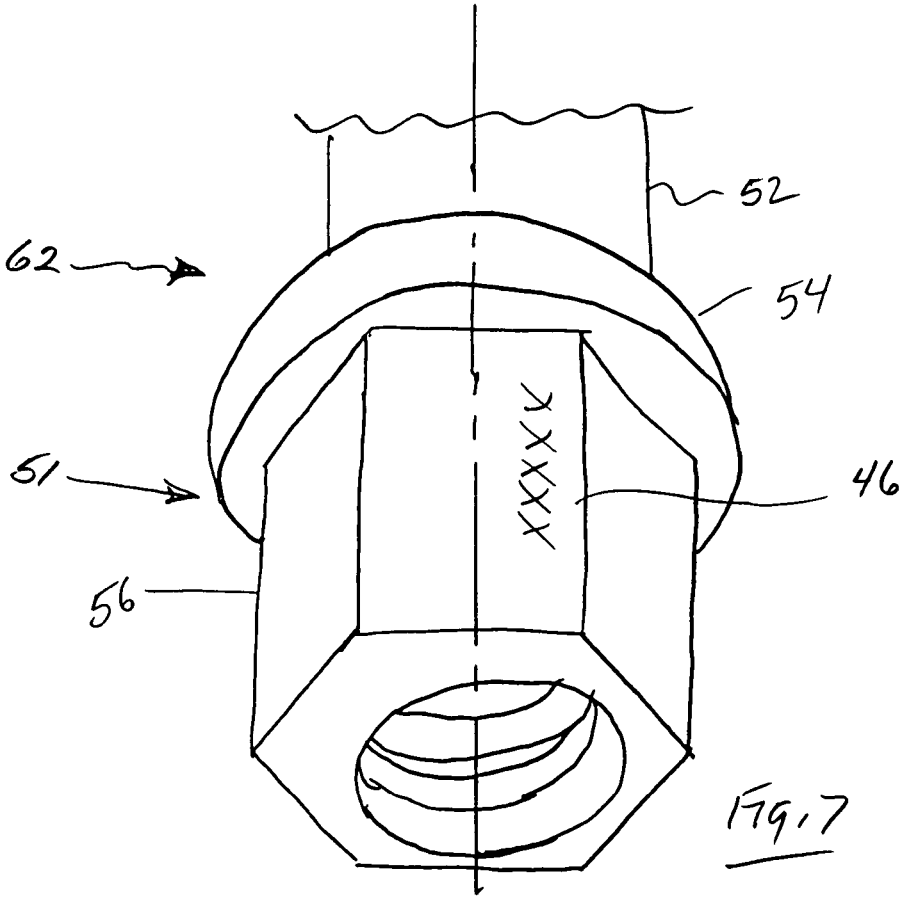
FIG. 7 shows a side perspective view of another embodiment of indicia location on a roof bolt.
Figure 8:
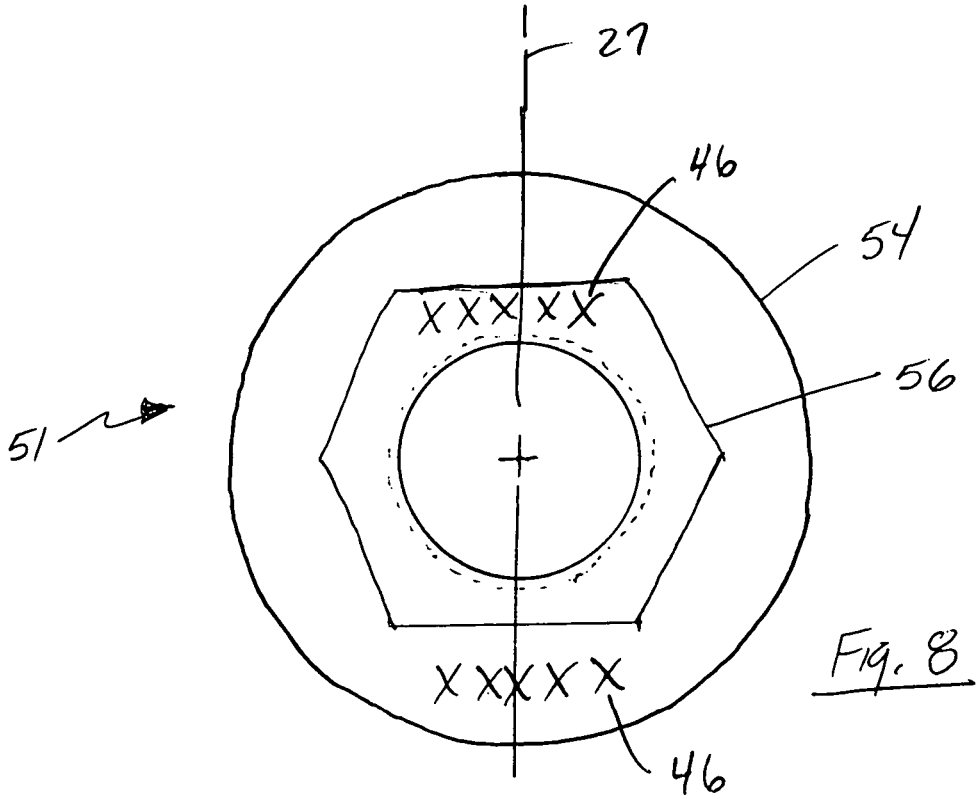
FIG. 8 shows an end view of another embodiment of indicia location of the device in FIG. 7.

FIGS. 7-8 show another embodiment of the head 51 of a roof bolt 62 with indicia 46 on the cup 54 and shoulder 56 of the head 51 of roof bolt 62. The indicia 46 in this embodiment of the head 51 could be located on the cup 54 alone, shoulder 56 alone or at both locations.

Figure 9:
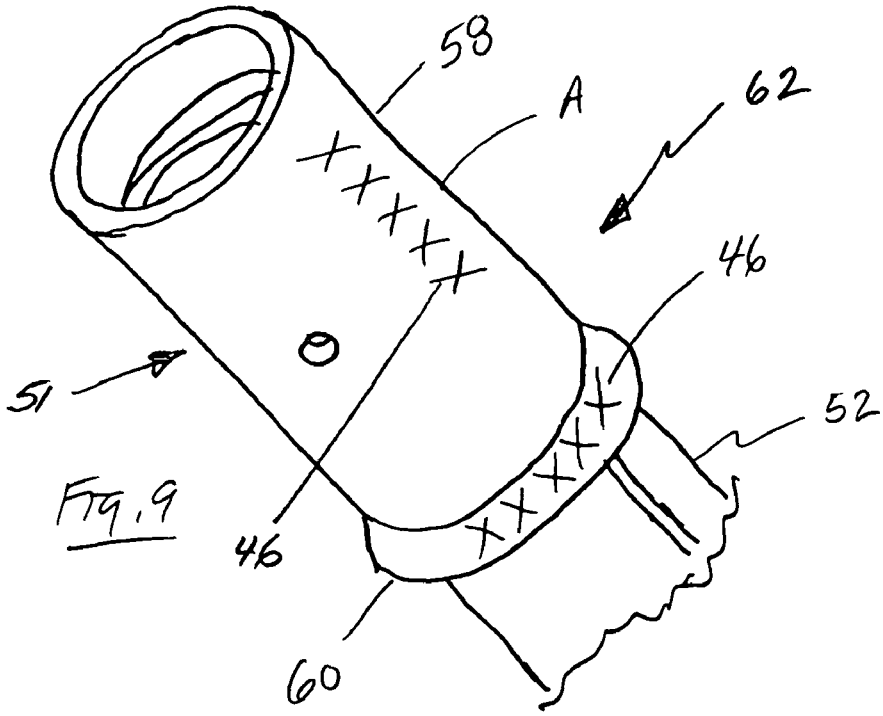
FIG. 9 shows a side perspective view of another embodiment of indicia location on a roof bolt.
Figure 10:
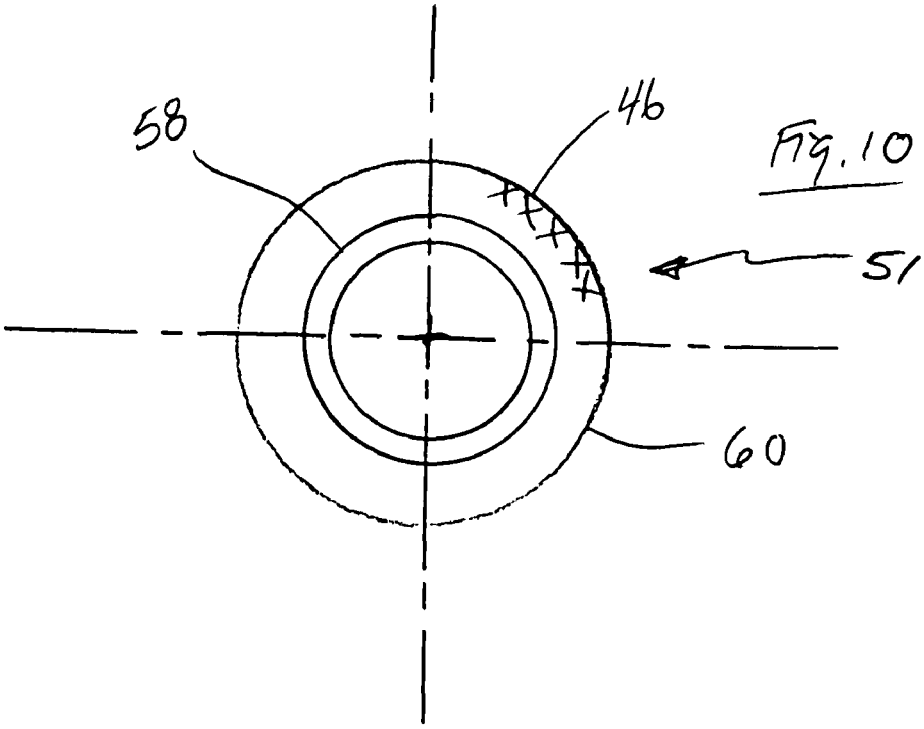
FIG. 10 shows an end view of another embodiment of indicia location of the device in FIG. 9.

FIGS. 9-10 show another embodiment of a roof bolt head 51 having a rod 58 attached to a flange 60. In this embodiment, indicia 46 can likewise be located on the rod 58 alone, flange 60 alone or at both locations.

As can be appreciated, having indicia 46 on one or multiple locations of the head 51 of a roof bolt 62 can aid the installer in verifying the properties of the roof bolt 62 and in matching the roof bolt 62 to the stabilizer 12. Clearly visible indicia 46 provides a better post installation check of the elements installed to verify the correct devices have been installed.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A stabilizer for securing surfaces in tunnels or mining, the stabilizer comprising:

a tube having a top end and a bottom end, the tube having a slot with parallel sides approximately parallel to an axis, the slot extending from the bottom end to the top end;

a taper manufactured in the top end of the tube;

the taper formed by folding the sidewall of the tube towards the center;

a circular ring having a bottom surface and a side surface, the ring having an opening;

the ring welded near the bottom end of the tube such that the ring opening is not concurrent with the slot in the tube; and indicia located on the ring to indicate the properties of the stabilizer.

2. The ring of claim 1, further comprising:

the indicia located on the bottom surface of the ring.

3. The ring of claim 1, further comprising:

the indicia located on the side surface of the ring.

4. The ring of claim 1, further comprising:

the indicia located on both the bottom surface and the side surface of the ring.

* * * * *